US012398015B2

(12) United States Patent
Tsugimura et al.

(10) Patent No.: US 12,398,015 B2
(45) Date of Patent: Aug. 26, 2025

(54) IMAGE FORMING APPARATUS

(71) Applicant: BROTHER KOGYO KABUSHIKI KAISHA, Nagoya (JP)

(72) Inventors: Koichi Tsugimura, Nagoya (JP); Haruka Azechi, Nagoya (JP); Masashi Ohhashi, Kasugai (JP); Yasuhiro Nakano, Nagoya (JP); Satoru Arakane, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 231 days.

(21) Appl. No.: 18/339,702

(22) Filed: Jun. 22, 2023

(65) Prior Publication Data

US 2024/0002183 A1 Jan. 4, 2024

(30) Foreign Application Priority Data

Jun. 30, 2022 (JP) ..... 2022-106376
Nov. 16, 2022 (JP) ..... 2022-183163

(51) Int. Cl.
*B65H 85/00* (2006.01)
*B65H 5/26* (2006.01)
*B65H 7/02* (2006.01)

(52) U.S. Cl.
CPC ..... *B65H 85/00* (2013.01); *B65H 5/26* (2013.01); *B65H 7/02* (2013.01); *B65H 2301/132* (2013.01); *B65H 2301/4189* (2013.01); *B65H 2405/332* (2013.01); *B65H 2407/21* (2013.01); *B65H 2511/11* (2013.01); *B65H 2511/414* (2013.01)

(58) Field of Classification Search
CPC ..... B65H 5/26
See application file for complete search history.

(56) References Cited

U.S. PATENT DOCUMENTS

2018/0088503 A1* 3/2018 Yamauchi ..... B65H 7/20
2022/0002102 A1* 1/2022 Koyanagi ..... G03G 15/234

FOREIGN PATENT DOCUMENTS

JP H10268585 A 10/1998
JP 2002-348051 A 12/2002

* cited by examiner

*Primary Examiner* — Prasad V Gokhale
(74) *Attorney, Agent, or Firm* — Merchant & Gould P.C.

(57) ABSTRACT

An image forming apparatus having a first container, a second container, an image forming device, a medium conveyer, a command acquiring device, and a controller, is provided. When a length of the medium to be conveyed is equal to or smaller than a first predetermined length, the controller controls the medium conveyer to convey the medium from the first container and the image forming device to perform an image forming operation on one of a first side and a second side of the medium, and, after the medium is accommodated in the second container in an orientation with the other of the first side and the second side to be used as the image-formable side, control the medium conveyer to convey the medium from the second container and control the image forming device to perform the image forming operation to the medium conveyed from the second container.

17 Claims, 6 Drawing Sheets

IMAGE FORMING APPARATUS

REFERENCE TO RELATED APPLICATIONS

This application claims priority from Japanese Patent Applications No. 2022-106376 filed on Jun. 30, 2022 and No. 2022-183163 filed on Nov. 16, 2022. The entire contents of the priority applications are incorporated herein by reference.

BACKGROUND ART

Image forming apparatuses capable of duplex conveyance for forming images on both sides of an image-formable medium are known. For duplex conveyance, such image forming apparatuses may have a switchback conveyer path. The image-formable medium may have an image formed on one side thereof by an image forming unit in the image forming apparatus and conveyed in the switchback conveyer path to reenter the image forming unit in an orientation such that the other side of the image-formable medium is not receivable of another image to be formed thereon. Accordingly, the images may be formed on the both sides of the image-formable medium.

DESCRIPTION

Meanwhile, image forming apparatuses capable of forming images on longer-sized image-formable media are known. For forming images on both sides of such longer-sized image-formable medium, however, depending on the length of the image-formable medium, conveying the longer-sized image-formable medium with an image formed on one side thereof through the switchback conveyer path to refeed to the image forming unit may not be easy.

The present disclosure is advantageous in that an image forming apparatus capable of forming images on both sides of a longer-sized image-formable medium with less difficulty is provided.

FIRST EMBODIMENT

Figure 1:
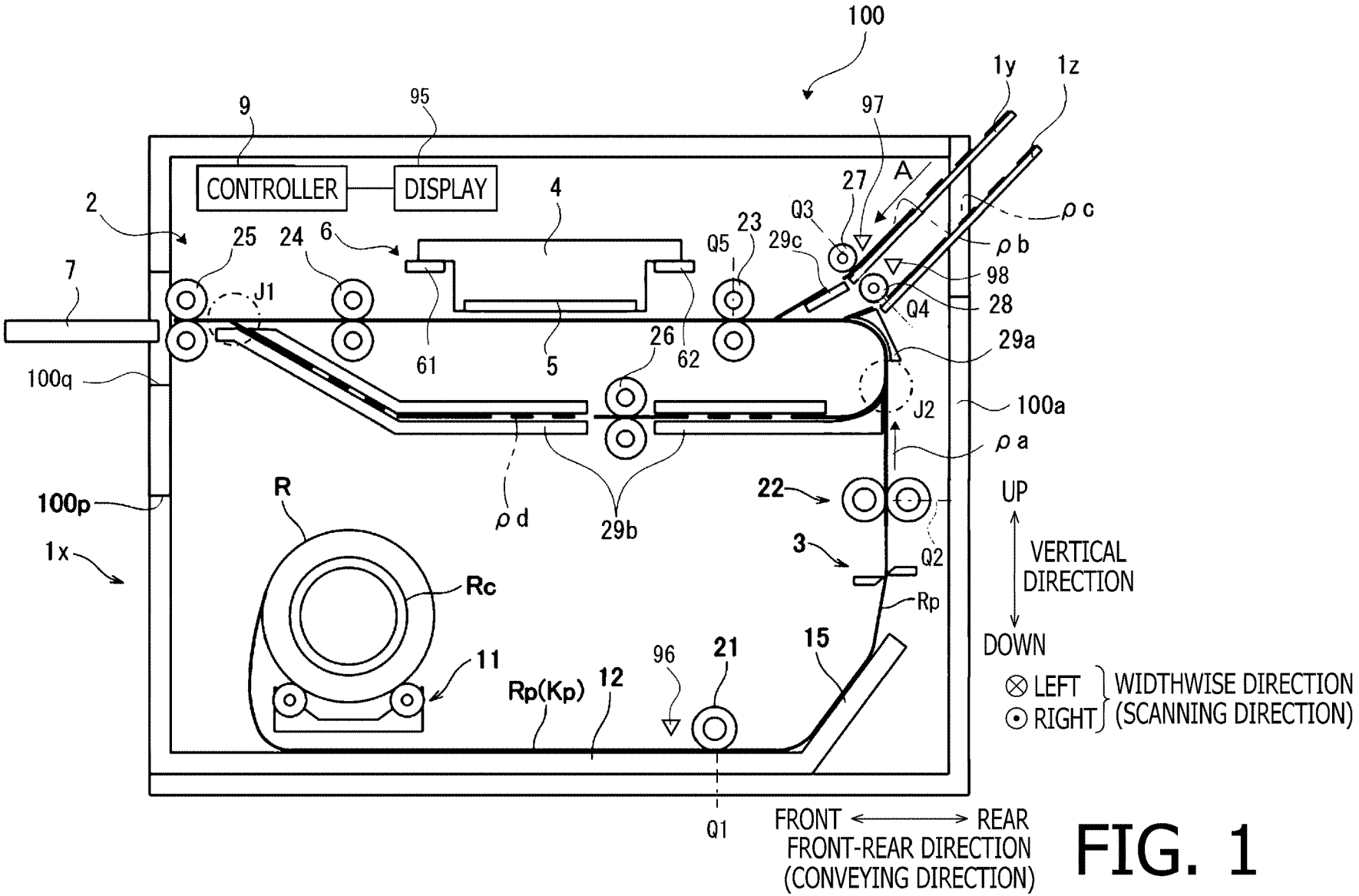
FIG. 1 is a schematic sideward view of an inner structure of a printer.

A printer 100 according to a first embodiment of the present disclosure will be described below with reference to FIGS. 1-3. In the following description, a front-to-rear or rear-to-front direction as indicated by a bidirectional arrow in FIG. 1 may be called as a front-rear direction in the printer 100, a left-to-right or right-to-left direction as indicated by a bidirectional arrow in FIG. 1 may be called as a widthwise direction in the printer 100, and an up-to-down or down-to-up direction as indicated by a bidirectional arrow in FIG. 1 may be called as a vertical direction in the printer 100. The front-rear direction, the widthwise direction, and the vertical direction intersect orthogonally with one another.

The printer 100 is an image forming apparatus capable of simplex printing, in which an image may be formed solely on one side, e.g., a front side, of a printable sheet P, and duplex printing, in which images may be formed on both one side, e.g., a front side, and the other side, e.g., a back side, of a sheet P. In the following paragraphs, the printable sheet P may be simply called "sheet P," and the one side, e.g., a front side, and the other side, e.g., a back side, of the sheet P may be called a first side and a second side of the sheet P, respectively. The printer 100 includes, as shown in FIG. 1, a housing 100*a*, feeder trays 1*x*, 1*y*, 1*z*, a conveyer 2, a cutter 3, a carriage 4, a head 5, a movable assembly 6, an ejection tray 7, and a controller 9.

The feeder tray 1*x* may accommodate the sheet P, on which an image may be printed. The sheet P includes a rolled sheet Rp being a longitudinal strip of paper and a cut sheet Kp, of which length is shorter than the rolled sheet Rp. The cut sheet Kp may be a sheet in a standard size such as, for example, A4 or B5. The feeder tray 1*x* may accommodate a roll R and/or the cut sheets Kp. The feeder tray 1*x* may accommodate both the roll R and the cut sheets Kp at the same time or may accommodate either one of the roll R and the cut sheets Kp optionally.

The feeder tray 1*x* has a roll holder 11 to support the roll R and a placement surface 12, on which the cut sheets Kp may be placed. The feeder tray 1*x* is located at a position lower than the head 5 in the housing 100*a*. The roll R may consist of a core Rc having a cylindrical form and the rolled sheet Rp being a strip of paper rolled around the core Rc. The cut sheet Kp may include a plurality of sheets of paper and may be stacked in layers on the placement surface 12. The feeder tray 1*x* is slidable along the front-rear direction with respect to the housing 100*a* through an opening 100*q*, which is formed on a front face of the housing 100*a*, to be mounted in or demounted from the housing 100*a*. On the placement surface 12, as will be described further below, not only the cut sheets Kp but also a piece of the rolled sheet Rp cut off from the roll R may be placed. In the following paragraphs, the piece of the rolled sheet Rp cut off from the roll R may also be called "rolled sheet Rp."

The feeder trays 1*y*, 1*z* are thinly formed containers, in which printable sheets P may be placed, and are arranged separately from the feeder tray 1*x*. The feeder trays 1*y*, 1*z* are arranged to vertically overlap each other. The feeder trays 1*y*, 1*z* are each arranged in an oblique posture, which inclines to be higher toward the rear side. The sheets P may be placed on upper surfaces of the feeder trays 1*y*, 1*z*.

The conveyer 2 may convey a sheet P from one of the feeder tray 1*x*, the feeder tray 1*y*, and 1*z* selectively to the head 5. The sheet P from the feeder tray 1*x* may be conveyed through a common conveyer path ρa, which is a path along a thicker line representing the rolled sheet Rp in FIG. 1, to the head 5. The common conveyer path ρa extends from the feeder tray 1*x* through the head 5 to the ejection tray 7. The common conveyer path ρa is a path used to convey the sheet P for both simplex printing and duplex printing. In the description below, terms "upstream" and "downstream" are used with reference to a conveying direction to convey the sheet P by the conveyer 2 along the common conveyer path ρa.

The conveyer 2 includes a feeder roller 21, an intermediate roller pair 22, conveyer roller pairs 23-25, and a guide 29*a*, for conveying the sheet P along the common conveyer path pa. The feeder roller 21, the intermediate roller pair 22, the conveyer roller pair 23, the conveyer roller pair 24, and the conveyer roller pair 25 are arranged in this given order from upstream to downstream along the common conveyer path ρa.

The feeder roller 21 may feed the sheet P from the feeder tray 1*x* and forward the sheet P in the common conveyer path ρa. The sheet P may either be the rolled sheet Rp extended from the roll R supported by the roll holder 11 or the cut sheet Kp placed on the placement surface 12. In the following context, when the rolled sheet Rp and the cut sheets Kp may not necessarily make difference, the rolled sheet Rp and the cut sheet Kp may be collectively called "sheet P."

The feeder roller 21 may be driven by a feeder motor 21*a* (see FIG. 2) to rotate. When the feeder motor 21*a* is activated under the control of the controller 9, the feeder roller 21 may rotate and apply a conveying force to convey the sheet P, which is in contact with the feeder roller 21, in a rearward direction. Thereby, the sheet P may be conveyed from the feeder tray 1*x*. A rear wall 15 formed at a rear end of the feeder tray 1*x* slants upper-rearward so that an upper end of the rear wall 15 is located rearward with respect to a lower end of the rear wall 15. In this arrangement of the rear wall 15, the sheet P conveyed by the feeder tray 1*x* may be directed upper-rearward.

The intermediate roller pair 22 consists of a driving roller that may be driven by an intermediate motor 22*a* (see FIG. 2) to rotate and a driven roller that may be rotated by the rotation of the driving roller. As the intermediate motor 22*a* is activated under the control of the controller 9, the intermediate roller pair 22 may nip the sheet P and rotate to convey the sheet P. The intermediate roller pair 22 is located above the rear end of the feeder tray 1*x*. The intermediate roller pair 22 may nip the sheet P fed from the feeder tray 1*x* by the feeder roller 21 and directed upper-rearward by the rear wall 15 to convey upward. The guide 29*a* is located above the intermediate roller pair 22. The guide 29*a* may guide the sheet P conveyed upward by the intermediate roller pair 22 to be conveyed frontward.

The conveyer roller pairs 23-25 each consist of a driving roller that may be driven to rotate by a conveyer motors 23*a*-25*a* (see FIG. 2), respectively, and a driven roller that may be rotated by the rotation of the driving roller. The conveyer roller pairs 23, 24 are located on one side and the other side of the head 5 along the front-rear direction. In particular, the conveyer roller pair 23 is located rearward, i.e., upstream in the conveying direction, and the conveyer roller pair 24 is located frontward, i.e., downstream in the conveying direction, with respect to the head 5. The conveyer roller pair 25 is located frontward, i.e., downstream in the conveying direction, with respect to the conveyer roller pair 24.

As the conveyer motors 23*a*-25*a* are driven under the control of the controller 9, the conveyer rollers pairs 23-25 may nip the sheet P and rotate to convey the sheet P. The conveyer roller pair 23 may convey the sheet P passed from the intermediate roller pair 22 to a position where the sheet P may face a lower surface of the head 5. At the position where the sheet P faces the lower surface of the head 5, the head 5 may perform an image forming operation to form an image on an image-formable side, i.e., an upper surface, of the sheet P. The conveyer roller pair 24 may receive the sheet P passed from the conveyer roller pair 23 and convey further frontward.

The conveyer roller pair 25 may receive the sheet P passed from the conveyer roller pair 24. For ejecting the sheet P outside at the ejection tray 7 after simplex printing or after forming images on both sides of the sheet P in duplex printing, the conveyer roller pair 25 may rotate in a forwarding direction.

The sheets P from the feeder tray 1*y* and the feeder tray 1*z* may be conveyed through a feeder path ρb and the feeder path ρc, respectively, and through the common conveyer path ρa to the head 5. The feeder paths ρb, ρc are delimited by the feeder tray 1*y*, 1*z* and guides 29*a*, 29*c*, respectively, which may guide the sheets P there-along. The conveyer 2 includes feeder rollers 27, 28 for conveying the sheets P along the feeder paths ρb, ρc, respectively. The feeder rollers 27, 28 may feed the sheets P from the feeder trays 1*y*, 1*z*, respectively. The feeder roller 27 may contact the sheet P placed on the feeder tray 1*y*, and the feeder roller 28 may contact the sheet P placed on the feeder tray 1*z*. The feeder rollers 27, 28 may be driven by feeder motors 27*a*, 28*a* (see FIG. 2) to rotate. When the feeder motor 27*a* or the feeder motor 28*a* is activated under the control of the controller 9, the feeder roller 27 or the feeder roller 28 may rotate and apply a conveying force to convey the sheet P, which is in contact with the feeder roller 27 or the feeder roller 28, in a direction along an arrow A in FIG. 1. Thereby, the sheet P may be conveyed from the feeder tray 1*y* or the feeder tray 1*z* along the feeder path ρb or the feeder path ρc. The sheet P fed by the feeder roller 27 or the feeder roller 28 may be forwarded to a position upstream from the conveyer roller pair 23 in the common conveyer path ρa.

The conveyer 2 further includes a reverse conveyer path ρd, which is a conveyer path used in duplex printing. The reverse conveyer path ρd is delimited by guides 29*b* for guiding the sheet P. The reverse conveyer path ρd is branched off from the common conveyer path ρa at a path-branch point J1 and extends downward to a position overlapping below the head 5 to a path-merge point J2 to merge with the common conveyer path ρa. The path-branch point J1 is located between the conveyer roller pair 24 and the conveyer roller pair 25. The path-merge point J2 is located between the intermediate roller pair 22 and the conveyer roller pair 23.

At an intermediate position in the reverse conveyer path ρd, a conveyer roller pair 26 is arranged. The conveyer roller pair 26 consists of a driving roller that may be driven by a conveyer motor 26*a* (see FIG. 2) to rotate and a driven roller that may be rotated by the rotation of the driving roller. As the conveyer motor 26*a* is activated under the control of the controller 9, the conveyer roller pair 26 may nip the sheet P and rotate to convey the sheet P. Thereby, the sheet P may be conveyed along the reverse conveyer path ρd.

In duplex printing, in which an image is formed on one side of the sheet P and another image is formed on the other side opposite to the one side of the sheet P one after the other, when the head 5 performs the image forming operation to form the image on the other side of the sheet P, the sheet P may be conveyed in the reverse conveyer path ρd by the conveyer roller pair 25 in a manner as follows. That is, the conveyer roller pair 25 receiving the sheet P passed from the conveyer roller pair 24 may convey the sheet P to a position, at which a rearward end, i.e., an end on the upstream side, of the sheet P is in the vicinity to conveyer roller pair 25, switch rotating directions from the forwarding direction to a reverse direction opposite to the forwarding direction, and convey the sheet P to enter the reverse conveyer path ρd through the path-branch point J1.

The conveyer roller pair 26 may receive the sheet P conveyed by the conveyer roller pair 25 to the reverse conveyer path ρd and convey the sheet P further rearward. The sheet P conveyed by the conveyer roller pair 26 may be further conveyed to reenter the common conveyer path ρa through the path-merge point J2. The sheet P reentering the common conveyer path ρa may be guided by the guide 29*a* and conveyed by the conveyer roller pair 23 in an orientation, in which an image-formable side, i.e., the other side opposite to the one side with the image having been formed thereon in the earlier image forming operation, faces the head 5. To the sheet P in this orientation, in which the image-formable side faces the head 5, the head 5 may perform the image forming operation to form the image on the other side of the sheet P.

At positions in the vicinities of the feeder rollers 21, 27, 28, sheet sensors 96, 97, 98, respectively, to detect presence of the sheet P are arranged. Based on outputs from the sheet sensors 96-98, the controller 9 may detect presence and amounts of the sheets P placed on the feeder trays 1*x*, 1*y*, 1*z*, respectively.

The cutter 3 is located upstream with respect to the intermediate roller pair 22 at a position between the rear end of the feeder tray 1*x* and the intermediate roller pair 22 in the common conveyer path ρa. The cutter 3 may consist of, for example, a disc-formed rotary blade and a subsidiary blade. As a cutter motor 3*a* (see FIG. 2) is activated, the cutter 3 may reciprocate in the widthwise direction, and the rotary blade may rotate. The rolled sheet Rp extended from the roll R may be cut by the cutter 3 in a cutoff-length indicated in user command data, which will be described below, along a crosswise direction of the rolled sheet Rp while the cutter motor 3*a* is active under the control of the controller 9. Thereby, a rear edge of the rolled sheet Rp is created, and the rolled sheet Rp cut off from the roll R may be ejected at the ejection tray 7.

Figure 2:
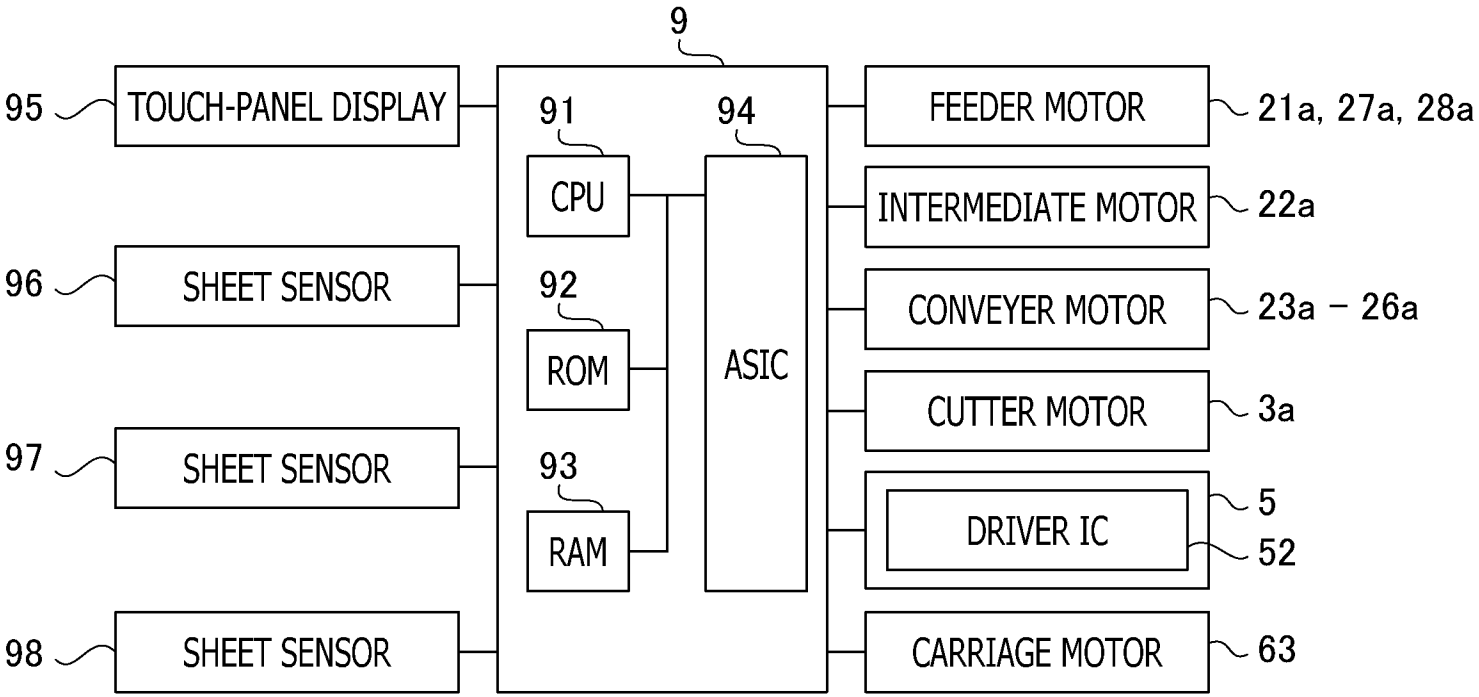
FIG. 2 is a block diagram of an electrical configuration of the printer.

The head 5 has a plurality of nozzles, which are formed on the lower face of the head 5, and a driver IC 52 (see FIG. 2). As the driver IC 52 is activated under the control of the controller 9, ink may be discharged from the nozzles, and the ink landing on the sheet P may form dots. The head 5 is mounted on the carriage 4.

The movable assembly 6 includes two guide rails 61, 62 and a carriage motor 63 (see FIG. 2). The guide rails 61, 62 are spaced apart from each other in the front-rear direction and extend in the widthwise direction. The carriage 4 is arranged to straddle the guide rail 61 and the guide rail 62. The carriage 4 is connected to the carriage motor 63 through, for example, a belt (not shown). As the carriage motor 63 is activated under the control of the controller 9, the carriage 4 may move in a scanning direction, i.e., the widthwise direction, along the guide rails 61, 62. The carriage 4 may move in one way and in the other way in the scanning direction to reciprocate in the scanning direction.

While the head 5 on the carriage 4 reciprocates in the scanning direction and discharges the ink from the nozzles, the head 5 may perform the image forming operation to form dots in lines on the sheet P along the scanning direction. Thus, the lines of dots along the scanning direction are formed on the sheet P sequentially while the sheet P is conveyed by the conveyer 2. Accordingly, in an image-formable range on the sheet P, an image, in which the dots are arrayed along the scanning direction and the conveying direction, may be formed. The image-formable range may be a rectangular range corresponding to a size of the image.

The ejection tray 7 is located at a position frontward with respect to the head 5 and higher than the feeder tray 1*x* in the housing 100*a*. The ejection tray 7 may be extended frontward or stowed vertically on the housing 100*a* through the opening 100*q* formed on the front face of the housing 100*a*. The sheet P, with the image(s) formed thereon by the head 5, may be conveyed through the opening 100*q* to exit and rest on the ejection tray 7.

A cartridge attachment section (not shown) is arranged inside the housing 100*a*. To the cartridge attachment section, four ink cartridges containing inks in colors of black, yellow, cyan, and magenta may be detachably attached. The inks in the cartridges attached to the cartridge attachment section may be supplied to the head 5 through, for example, tubes.

On the front face of the housing 100*a*, a touch-panel display 95 is arranged. The touch-panel display 95 may display images and text on a screen thereof under the control of the controller 9. Further, the touch-panel display 95 may detect a position on the screen touched by a user and output the detected position to the controller 9.

The controller 9 may control overall behaviors of the printer 100. As shown in FIG. 2, the controller 9 is electrically connected with the feeder motors 21*a*, 27*a*, 28*a*, the intermediate motor 22*a*, the conveyer motors 23*a*-26*a*, the cutter motor 3*a*, the driver IC 52, the carriage motor 63, the touch-panel display 95, and the sheet sensors 96-98.

The controller 9 includes, as shown in FIG. 2, a central processing unit (CPU) 91, a read-only memory (ROM) 92, a random access memory (RAM) 93, an application specific integrated circuit (ASIC) 94.

The ROM 92 may store programs to be run by the CPU 91 and the ASIC 94. Moreover, the ROM 92 may store reference values to be referred to by the CPU 91. For example, the ROM 92 stores reference values that may be referred to by the CPU 91 when determining whether an automatic duplex operation is to be performed. The automatic duplex operation will be described below. For another example, the ROM 92 stores manual-operation allowable values. The manual-operation allowable values are reference values indicating lengths of the rolled sheet Rp acceptable in the feeder trays 1*x*, 1*y*, 1*z* in manual duplex operation, which will be described in detail below.

The manual-operation allowable values consist of a maximum value and a minimum value indicating lengths of the rolled sheet Rp acceptable in each of the feeder trays 1*x*, 1*y*, 1*z*. The maximum values and the minimum values indicating the lengths of the rolled sheet Rp acceptable in the feeder trays 1*x*, 1*y*, 1*z* are prepared in advance according to distances from the feeder rollers 21, 27, 28 in the feeder trays 1*x*, 1*y*, 1*z*, to the downstream roller next to the feeder rollers 21, 27, 28 in the conveyer path and sizes of the feeder trays 1*x*, 1*y*, 1*z*. For example, maximum values $MAX_{1x}$, $MAX_{1y}$, and $MAX_{1z}$ in the manual-operation allowable values are set to maximum values for the sheets P that are acceptable in the trays 1*x*, 1*y*, 1*z*, respectively. The greater the sizes of the feeder trays 1*x*, 1*y*, 1*z* are, the greater the lengths of the sheet P acceptable in the feeder trays 1*x*, 1*y*, 1*z* are. The minimum value $MIN_{1x}$ of the manual-operation allowable value for the feeder tray 1*x* is set to a value representing a longer one of two distances: a distance between a position Q1 of the feeder roller 21 and a position Q2 of the intermediate roller pair 22 along the common conveyer path ρa, and a distance between the position Q2 of the intermediate roller pair 22 and a position Q5 of the conveyer roller pair 23 along the common conveyer path ρa (see FIG. 1). A minimum value $MINz_{1y}$ of the manual-operation allowable value for the feeder tray 1*y* is set to a value representing a distance, which is greater than a distance between a position Q3 of the feeder roller 27 and the position Q5 of the conveyer roller pair 23 along the feeder path ρb and the common conveyer path ρa (see FIG. 1). A minimum value $MIN_{1z}$ of the manual-operation allowable value for the feeder tray 1$z$ is set to a value representing a distance, which is greater than a distance between a position Q4 of the feeder roller 28 and the position Q5 of the conveyer roller pair 23 along the feeder path ρc and the common conveyer path ρa (see FIG. 1).

TABLE 1

| | Manual-Operation Allowable Value | |
|---|---|---|
| Feeder Tray | Maximum Value | Minimum Value |
| 1x | $MAX_{1x}$ | $MIN_{1x}$ |
| 1y | $MAX_{1y}$ | $MIN_{1y}$ |
| 1z | $MAX_{1z}$ | $MIN_{1z}$ |

The RAM 93 may store data to be used in the running programs temporarily. The data to be stored in the RAM 93 may include data, which may be transmitted from an external device such as a PC through a communication interface (not shown) or may be acquired from a memory medium through a medium connector (not shown). The controller 9 acquiring the data may store the data in the RAM 93. The data may include, for example, image data composing images to be formed on the sheet P and the user command data indicating a command from a user including information concerning formation of the image. The information included in the user command data may include information indicating selection of the sheet P to be used between the cut sheet Kp and the rolled sheet Rp, information indicating the cutoff-length, when the sheet P to be used is the rolled sheet Rp, information indicating selection between simplex printing and duplex printing, and information related to characteristics of the sheet P to be used such as hardness, thickness, etc.

Moreover, the RAM 93 may store priority data indicating priorities of the feeder trays 1$x$, 1$y$, 1$z$ set by the user. The priority data may indicate an order, for example, such that the feeder tray 1$x$ is ranked third, the feeder tray 1$y$ is ranked first, and the feeder tray 1$z$ is ranked second. The priority may either be ranked by the user through the touch-panel display 95 or ranked according to data received from an external device such as a PC.

Optionally, the controller 9 may have the CPU 91 alone or the ASIC 94 alone to conduct the processes or may have the CPU 91 and the ASIC 94 cooperating with each other to conduct the processes. Optionally, moreover, the controller 9 may have a single CPU 91 that may conduct the processes or may have a plurality of CPUs 91 sharing the processes. Optionally, moreover, the controller 9 may have a single ASIC 94 that may conduct the processes or may have a plurality of ASICs 94 sharing the processes.

The controller 9 may conduct one of a duplex operation, in which the conveyer 2, the cutter 3, and the head 5 are controlled for duplex printing, i.e., printing images on both sides of the sheet P, and a simplex operation, in which the conveyer 2, the cutter 3, and the head 5 are controlled for simplex printing, i.e., printing an image solely on one side of the sheet P, selectively. The controller 9 may conduct the duplex operation when the user command data indicates duplex printing, or may conduct the simplex operation when the user command data indicates simplex printing.

In the simplex printing process, the controller 9 may repeat an act of operating the conveyer 2 to convey the sheet P along the conveyer path by a predetermined distance and an act of operating the movable assembly 6 to move the carriage 4 in the scanning direction and the head 5 to discharge the inks from the nozzles at the sheet P alternately, based on the image data stored in the RAM 93.

When the sheet P is the rolled sheet Rp, the rolled sheet Rp may be extended and conveyed by the conveyer 2, and the inks may be discharged from the head 5 at the rolled sheet Rp extended from the roll R and being conveyed by the conveyer 2. The rolled sheet Rp may be cut in the cutoff-length indicated in the user command data by the cutter 3 operated under the control of the controller 9. The rolled sheet Rp cut off by the cutter 3 may be ejected into the ejection tray 7 as a sheet P of paper having the predetermined length with the image formed on one side thereof.

When the sheet P is the cut sheet Kp, the cut sheet Kp may be conveyed by the conveyer 2, and the inks may be discharged from the head 5 at the cut sheet Kp being conveyed by the conveyer 2. Accordingly, the cut sheet Kp may be ejected into the ejection tray 7 as a sheet P with the image formed on one side thereof.

The duplex printing process includes an automatic duplex operation and a manual duplex operation. In the automatic duplex operation, the printer 100 may complete a series of operations automatically from the start of printing an image on one side to the end of printing another image on the other side of the sheet P. In the manual duplex operation, a part of the operations is performed by the user.

In the automatic duplex operation, the sheet P may be conveyed to the head 5 by the conveyer 2 in an orientation, in which a first side is used as the image-formable side, and may receive the inks discharged from the head 5. Thereby, the image may be formed on the first side of the sheet P. Thereafter, if the sheet P is the cut sheet Kp, the cut sheet Kp with the image formed on the first side thereof may be conveyed by the conveyer 2 to return to the head 5 in an orientation with the second side thereof opposite to the first side having the image formed thereon earlier to be used as the image-formable side and may receive the inks discharged from the head 5 on the second side. Thereby, the cut sheet Kp with the images formed on both sides thereof may be ejected by the conveyer 2 into the ejection tray 7.

On the other hand, if the sheet P is the rolled sheet Rp, after forming the image on the first side of the rolled sheet Rp, the rolled sheet Rp may be cut by the cutter 3 under the control of the controller 9 in the cutoff-length indicated in the user command data. The rolled sheet Rp cut off from the roll R by the cutter 3 may be conveyed to return to the head 5 in an orientation with the second side opposite to the first side having the image formed thereon earlier to be used as the image-formable side and may receive the inks discharged from the head 5 on the second side. Thereby, the rolled sheet RP with the images formed on both sides thereof may be ejected by the conveyer 2 into the ejection tray 7.

During the automatic duplex operation, for conveying the rolled sheet Rp cut off from the roll R by the cutter 3 to return to the head 5, if the cutoff-length of the rolled sheet Rp is excessively long, the rolled sheet Rp may not be conveyed correctly in the conveyer paths. For example, if the cutoff-length of the rolled sheet Rp is longer than a length of a closed path, which starts from the path-branch point J1 extending through the reverse conveyer path ρd, the path-merge point J2, the common conveyer path ρa, and returning to the path-branch point J1 (see FIG. 1), when a leading edge of the rolled sheet Rp returns to the path-branch point J1, the leading edge of the rolled sheet Rp may collide with the trailing part of the rolled sheet Rp still passing through the path-branch point J1. In such a case, the rolled sheet Rp may jam at the path branch point J and may not be conveyed further correctly.

Therefore, the controller 9 in the present embodiment may conduct the automatic duplex operation to the rolled sheet Rp as long as the cutoff-length of the sheet P indicated in the user command data is equal to or smaller than an automatic duplex-operation allowable value stored in the ROM 92. On the other hand, when the cutoff-length of the sheet P indicated in the user command data is greater than the automatic duplex-operation allowable value, the controller 9 may conduct a manual duplex operation, which will be described below, to the rolled sheet Rp. The automatic duplex-operation allowable value may be set to, for example, a value representing a length equal to or smaller than the length of the closed path mentioned above. Thus, according to the present embodiment, when the cutoff-length is equal to or smaller than the automatic duplex-operation allowable value, the automatic duplex operation may be conducted, but when the cutoff-length is greater than the automatic duplex-operation allowable value, the manual duplex operation may be conducted.

In the manual duplex operation, the rolled sheet Rp may be conveyed to the head 5 by the conveyer 2 in an orientation, in which the first side is used as the image-formable side, and may receive the inks discharged from the head 5. Thereby, the image may be formed on the first side of the rolled sheet Rp. The rolled sheet Rp with the image formed on the first side may be cut off by the cutter 3 under the control of the controller 9 in the cutoff-length indicated in the user command data. The rolled sheet Rp cut off by the cutter 3 may be ejected by the conveyer 2 into the ejection tray 7. The rolled sheet Rp may be picked up from the ejection tray 7 by the user.

Thereafter, the controller 9 may determine whether the cutoff-length of the rolled sheet Rp indicated in the user command data is encompassed in any of the ranges defined by the manual-operation allowable values for the feeder trays 1*x*, 1*y*, 1*z* stored in the ROM 92. If the cutoff-length of the rolled sheet Rp is encompassed in any of the ranges defined by the manual-operation allowable values for the feeder trays 1*x*, 1*y*, 1*z*, the controller 9 may control the touch-panel display 95 to display one of the feeder trays 1*x*, 1*y*, or 1*z*, having the ranges of the manual-operation allowable values that may accept the cutoff-length of the rolled sheet Rp. The feeder tray 1*x*, 1*y*, or 1*z* to be displayed in the touch-panel display 95 is one of the feeder trays 1*x*, 1*y*, 1*z* having the highest priority rank among the feeder trays 1*x*, 1*y*, 1*z*, having the ranges of the manual-operation allowable values that may accept the cutoff-length of the rolled sheet Rp. For example, while the feeder trays 1*x*, 1*y*, 1*z* may be ranked third, first, and second, respectively, in the priority, the cutoff-length may be encompassed in the ranges of the manual-operation allowable values for the feeder trays 1*y*, 1*z* but may fall outside the range of the manual-operation allowable value of the feeder tray 1*x*. In this case, between the feeder tray 1*y* and the feeder tray 1*z* both having the ranges of the manual-operation allowable values acceptable of the cutoff-length, the touch-panel display 95 may display the feeder tray 1*y*, of which priority is higher. If none of the ranges of the manual-operation allowable values for the feeder trays 1*x*, 1*y*, 1*z*, is acceptable of the cutoff-length, the controller 9 may abort the manual duplex operation. Thus, the controller 9 may conduct the manual duplex operation based on the determination whether any of the feeder trays 1*x*, 1*y*, 1*z* has the range of the manual-operation allowable value acceptable of the cutoff-length.

Next, the user may place the rolled sheet Rp with the image formed on the first side thereof, picked up from the ejection tray 7, in the feeder tray 1*x*, 1*y*, or 1*z* indicated in the touch-panel display 95. The user may place the rolled sheet Rp in the feeder tray 1*x*, 1*y*, or 1*z* in an orientation, in which the second side of the rolled sheet Rp opposite to the first side having the image formed thereon is used as the image-formable side. When, for example, the rolled sheet Rp is placed in the feeder tray 1*x*, the user may place the rolled sheet Rp on the placement surface 12 in the feeder tray 1*x*.

Based on the outputs from the sheet sensors 96-98, the controller 9 may determine that the rolled sheet Rp is placed on the one of the feeder trays 1*x*, 1*y*, 1*z* indicated in the touch-panel display 95. The controller 9 may operate the conveyer 2 to convey the rolled sheet Rp to return to the head 5 in the orientation such that the second side opposite to the first side faces the head 5 as the image-formable side. The rolled sheet Rp returning to the head 5 may receive the inks discharged from the head 5. Thus, the rolled sheet Rp with the images formed on both sides thereof may be ejected by the conveyer 2 into the ejection tray 7.

Thus, through the manual duplex operation described above, an image may be formed on the first side of the rolled sheet Rp conveyed to the head 5, the rolled sheet Rp may be cut off from the roll R by the cutter 3, the rolled sheet Rp cut off from the roll R with the image formed on the first side thereof may be placed in one of the feeder trays 1*x*, 1*y*, 1*z* by the user, and thereafter, the rolled sheet Rp may be refed to the head 5, and another image may be formed on the second side opposite to the first side on the rolled sheet Rp.

Next, the duplex operation with the rolled sheet Rp conducted by the controller 9 will be described with reference to the flowchart shown in FIG. 3.

First, the controller 9 acquires the user command data from the RAM 93 and determines whether the cutoff-length of the rolled sheet Rp indicated in the user command data is equal to or smaller than the automatic duplex-operation allowable value (S1). If the cutoff-length is equal to or smaller than the automatic duplex-operation allowable value, in other words, if the controller 9 determines that the automatic duplex operation is applicable (S1: YES), the controller 9 conducts the automatic duplex operation (S11) and ends the flow.

If the controller 9 determines that the cutoff-length is greater than the automatic duplex-operation allowable value (S1: YES), the controller 9 controls the conveyer 2, the cutter 3, and the head 5 to form an image on a first side of the rolled sheet Rp and cut the rolled sheet Rp in the cutoff-length (S2). Following S2, the sheet P may be processed in the manual duplex operation. That is, the controller 9 appoints one of the feeder trays 1*x*, 1*y*, 1*z* having the highest priority to a prospect tray (S3). In S4, the controller 9 acquires the manual-operation allowable value for the prospect tray (S4).

The controller 9 determines whether the cutoff-length indicated in the user command data is encompassed in a range defined by the manual-operation allowable value for the prospect tray, in other words, whether the prospect tray is usable for printing an image on the second side of the rolled sheet Rp (S5). If the controller 9 determines that the cutoff-length falls outside the range defined by the manual-operation allowable value for the prospect tray, in other words, the prospect tray is not usable for printing the image on the second side of the rolled sheet Rp (S5: NO), the controller 9 determines whether a next prospect tray is available, in other words, whether there remains at least one feeder tray among the feeder trays 1*x*, 1*y*, 1*z* that is not yet appointed to a prospect tray (S12). If the controller 9 determines that there remains no feeder tray that is not yet appointed to a prospect tray (S12: NO), the controller 9 ends the flow. On the other hand, if the controller 9 determines that there remains at least one feeder tray that is not yet appointed to a prospect tray (S12: YES), the controller 9 appoints one of the at least one feeder tray that is not yet appointed to a prospect tray according to the priority order (S13). Thereafter, the controller 9 returns to S4.

In S5, meanwhile, if the controller 9 determines that the cutoff-length is encompassed in the range defined by the manual-operation allowable value for the prospect tray, in other words, the prospect tray is usable for printing the image on the second side of the rolled sheet Rp (S5: YES), the controller 9 operates the touch-panel display 95 to display an instruction for the user to place the rolled sheet Rp in the prospect tray (S6). The controller 9 awaits until the outputs from the sheet sensors 96-98 indicate that the rolled sheet Rp is placed on the prospect tray (S7: NO). When the rolled sheet Rp is placed on the prospect tray (S7: YES), the controller 9 controls the conveyer 2 and the head 5 to form the image on the second side of the rolled sheet Rp. Thereafter, the controller 9 ends the flow.

According to the embodiment described above, the automatic duplex operation may be conducted when the cutoff-length of the rolled sheet Rp indicated in the user command data is equal to or smaller than the automatic duplex-operation allowable value. On the other hand, the manual duplex operation may be conducted when the cutoff-length of the rolled sheet Rp indicated in the user command data is greater than the automatic duplex-operation allowable value and when the usable feeder tray is available. In other words, when the length of the rolled sheet Rp cut off from the roll R is too long to be conveyed through the reverse conveyer path ρd, the images may be printed on the rolled sheet Rp through the manual duplex operation rather than the automatic duplex operation. Thus, on the lengthened rolled sheet Rp that requires cutting, the images may be formed on the both sides through the manual duplex operation.

According to the embodiment described above, the feeder trays 1*x*, 1*z*, 1*y* may be provided with different manual-operation allowable values, and the manual duplex operation may be conducted when the cutoff-length of the rolled sheet Rp indicated in the user command data is encompassed in one of the ranges of the manual-operation allowable values. Thus, the manual duplex operation may be conducted based on the determination that the feeder tray is usable in the manually duplex operation.

Moreover, according to the embodiment described above, during the manual duplex operation, the feeder tray to accept the rolled sheet Rp may be displayed in the touch-panel display 95. Therefore, the user may place the rolled sheet Rp, on the first side of which the image is already formed, on the feeder tray as instructed in the touch-panel display 95 to continue the manual duplex operation easily.

SECOND EMBODIMENT

A second embodiment according to the present disclosure will be described below. Differences in configurations between the first embodiment and the second embodiment are limited, and the second embodiment is largely common with the first embodiment. Therefore, in the following paragraphs, parts and items that are substantially like those in the printer 100 described above will be referred to by the same reference sings, and detailed description of those will be herein omitted.

According to the manual duplex operation in the second embodiment, a process, in which an image is formed on one side, e.g., a first side, of the rolled sheet Rp and the rolled sheet Rp is cut off from the roll R, may be repeated for a number of times. The number of the process to be repeated corresponds to a number of rolled sheets Rp indicated in the user command data. The number of rolled sheets Rp cut off from the roll R, on the first sides of which the images are formed, may be once collected by the user. The user may place the collected rolled sheets Rp on one of the feeder trays 1*x*, 1*y*, 1*z*. The rolled sheets Rp may be refed to the head 5 sequentially, and images may be formed on the other side, e.g., second sides, of the rolled sheets Rp.

As described below, the second embodiment is different from the first embodiment in a way how the controller 9 determines whether the automatic duplex operation is applicable and whether the manual duplex operation is applicable.

The duplex operation with the rolled sheet Rp conducted by the controller 9 according to the second embodiment will be described with reference to the flowchart shown in FIG. 4. The processing flow in the flowchart shown in FIG. 4 corresponds to the processing flow in the flowchart according to the first embodiment shown in FIG. 3.

First, the controller 9 determines, based on the information concerning formation of the image indicated in the user command data, whether the automatic duplex operation is applicable (S101). In the second embodiment, determination whether the automatic duplex operation is applicable depends on, not only the condition whether cutoff-length of the rolled sheet Rp indicated in the user command data is equal to or smaller than the automatic duplex-operation allowable value, but also a condition concerning a sheet type indicated in the user command data. For example, the determination may be made depending on a condition whether the characteristics of the sheet P, such as hardness, thickness, etc., indicated in the user command data match characteristics that are unsuitable for the automatic duplex operation. Thus, the determination may be made depending on, not only the condition related to the automatic duplex-operation allowable value, but also the condition concerning the sheet type.

In particular, the determination may be made depending on a condition whether a sheet type indicated in the user command data has characteristics falling into a specific type unsuitable for the automatic duplex operation. The controller 9 may determine the automatic duplex operation is applicable (S101: YES) when the cutoff-length of the rolled sheet Rp indicated in the user command data is equal to or smaller than the automatic duplex-operation allowable value and, further, when the sheet type indicated in the user command data does not fall into the specific type. Following S101, the controller 9 conducts the automatic duplex operation (S111) and ends the flow. On the other hand, when the cutoff-length of the rolled sheet Rp indicated in the user command data is greater than the automatic duplex-operation allowable value, and/or the sheet type indicated in the user command data falls into the specific type, the controller 9 determines that the automatic duplex operation is not applicable (S101: NO). Accordingly, the controller 9 controls the conveyer 2, the cutter 3, and the head 5 to form an image on one side, e.g., a first side, of the rolled sheet Rp and cut off the rolled sheet Rp from the roll R (S102). Following S102, the controller 9 conducts the manual duplex operation. S102 is repeated for a number of times corresponding to the number of sheets to be printed indicated in the user command data (S103: NO, S102, S103: NO, S102, . . . ).

When the controller 9 determines that S102 is repeated for the number of times corresponding to the number of sheets to be printed indicated in the user command data (S103: YES), the controller 9 appoints one of the feeder trays 1$x$, 1$y$, 1$z$ having the highest priority to a prospect tray (S104). Next, the controller 9 acquires condition values related to the prospect tray (S105). The condition values to be acquired include, further to the manual-operation allowable values, duplex-operation unsuitable types and stackable amount values, which are defined to the respective feeder trays 1$x$, 1$y$, 1$z$, as shown in Table 2 below. The duplex-operation unsuitable types are sheet types, of which characteristics of the sheets are unsuitable for the manual duplex operation. The stackable amount values correspond to maximum allowable number of sheets stackable on the feeder trays 1$x$, 1$y$, 1$z$.

TABLE 2

| Feeder Tray | Duplex-Operation Unsuitable Type | Stackable Amount Value |
|---|---|---|
| 1x | $TYPE_{1x}$ | $MAX_{1x}$ |
| 1y | $TYPE_{1y}$ | $MAX_{1y}$ |
| 1z | $TYPE_{1z}$ | $MAX_{1z}$ |

Following S5, the controller 9 determines whether the prospect tray is capable of printing images on the other sides, e.g., second sides, of the rolled sheets Rp based on the condition values acquired in S104 (S106). In particular, the controller 9 determines whether the cutoff-length is encompassed in the range of the manual duplex-operation allowable value (see Table 1), whether the sheet type indicated in the user command data does not fall into the duplex-operation unsuitable type, and whether the number of the rolled sheets Rp to be printed indicated in the user command data is equal to or smaller than the stackable amount value. Thus, the controller 9 may determine in S106 whether the prospect tray is usable based on the three conditions, and at least one of the three conditions is related to the characteristics of the sheets P to be used. When at least one of the three conditions is not satisfied, the controller 9 determines the prospect tray is not capable of being used in the manual duplex operation (S106: NO). The controller 9 determines whether a next prospect tray is available, in other words, whether there remains at least one feeder tray among the feeder trays 1$x$, 1$y$, 1$z$ that is not yet appointed to a prospect tray (S112). If the controller 9 determines that there remains no feeder tray that is not yet appointed to a prospect tray (S112: NO), the controller 9 ends the flow. On the other hand, if the controller 9 determines that there remains at least one feeder tray that is not yet appointed to a prospect tray (S112: YES), the controller 9 appoints one of the at least one feeder tray that is not yet appointed to a prospect tray according to the priority (S113). Thereafter, the controller 9 returns to S105.

In S106, if the three conditions are all satisfied, the controller 9 determines that the prospect tray is capable of being used in the manual duplex operation (S106: YES). Following S106, the controller 9 operates the touch-panel display 95 to display an instruction for the user to place the rolled sheets Rp in the appointed feeder tray (S107). The controller 9 awaits according to the outputs from the sheet sensors 96-98 until the rolled sheets Rp are placed on the appointed feeder tray (S108: NO). When the rolled sheets Rp are placed on the appointed feeder tray (S108: YES), the controller 9 controls the conveyer 2 and the head 5 to form the images on the second sides of the rolled sheets Rp (S109). The flow of S109-S110 is repeated for a number of times corresponding to the number of rolled sheets Rp to be printed indicated in the user command data (S110: NO, S109, S1110: NO, S109, . . . ). When the controller 9 determines that the flow of S110-S109 is repeated for the number of times corresponding to the number of rolled sheets Rp to be printed indicated in the user command data (S110: YES), the controller 9 ends the flow.

According to the second embodiment, further to the benefits achievable in the first embodiment described above, the following benefits may be achieved. That is, for determining whether the automatic duplex operation is applicable (S101 in FIG. 4), the controller 9 refers to not only the cutoff-length of the rolled sheet Rp but also the sheet type concerning the characteristics of the rolled sheet Rp such as hardness, thickness, etc. In other words, feasibility of the rolled sheets Rp to form images on both sides thereon in the automatic duplex operation may be determined finely. Moreover, for conducting the manual duplex operation, suitableness of the sheet type may be determined on basis of the feeder trays 1$x$, 1$y$, 1$z$ (S106 in FIG. 4). In other words, capabilities of the feeder trays 1$x$, 1$y$, 1$z$ in forming the images on the both sides of the rolled sheets Rp in the manual duplex operation may be determined finely.

Moreover, according to the second embodiment, for conducting the manual duplex operation, images may be formed repetitively on the first sides of the number of rolled sheets Rp, as indicated in the user command data, and thereafter, more images may be formed on the second sides of the rolled sheets Rp. Thus, the duplex operation may be conducted to the number of rolled sheets Rp efficiently. Moreover, for conducting the manual duplex operation to the number of rolled sheets Rp, whether the number is acceptable to the feeder tray may be determined adequately.

THIRD EMBODIMENT

A third embodiment according to the present disclosure will be described below. Differences in configuration of a printer 200 in the third embodiment from the first and second embodiments are limited, and the third embodiment is largely common with the first and second embodiments. Therefore, in the following paragraphs, parts and items that are substantially like those in the printer 100 described above will be referred to by the same reference sings, and detailed description of those will be herein omitted.

Figure 5:
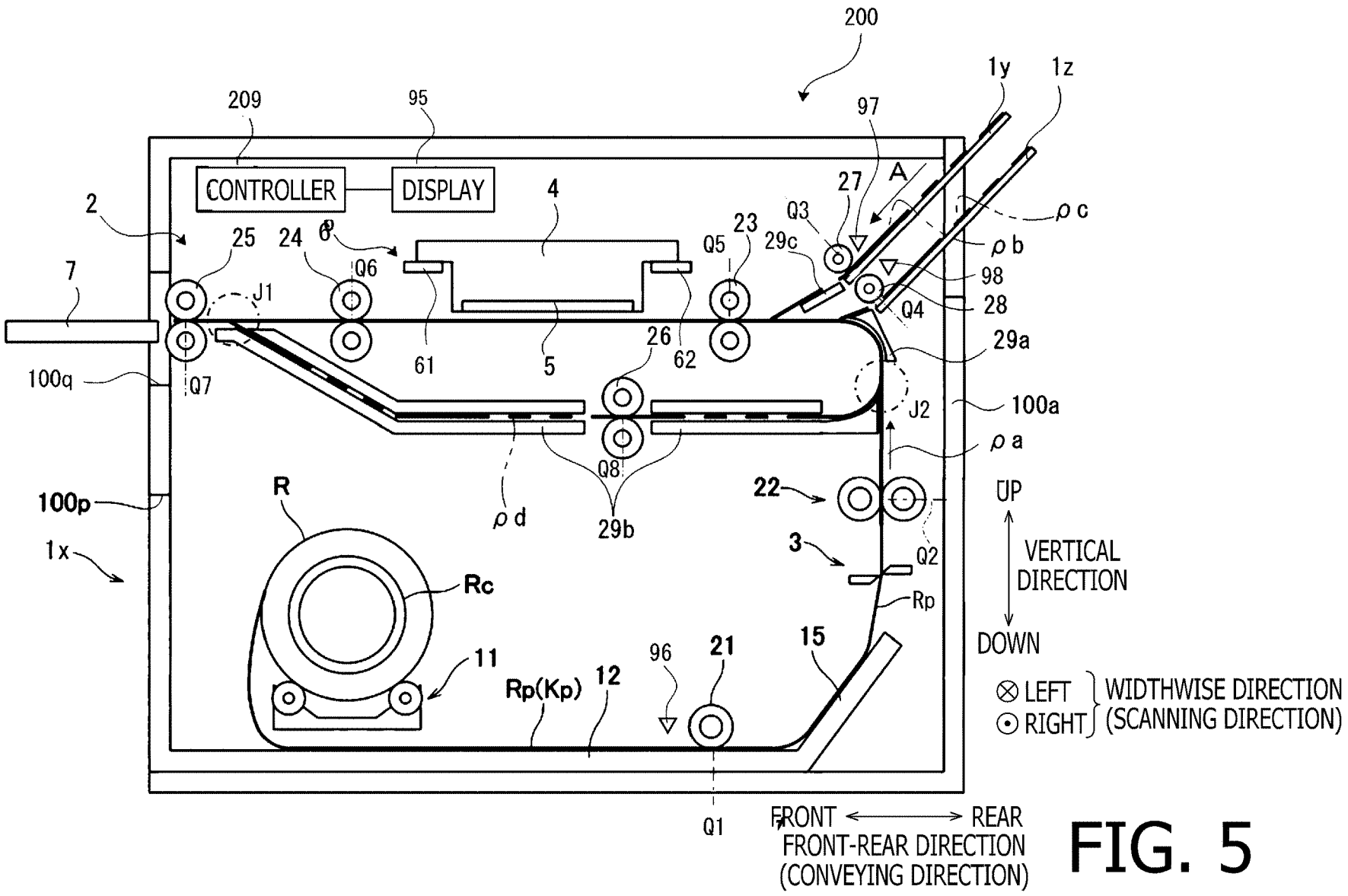
FIG. 5 is a schematic sideward view of an inner structure of a printer.

In the printer 200 according to the third embodiment, as shown in FIG. 5, the conveyer roller pairs 24-25 and the conveyer roller pair 26 are located on the common conveyer path ρa and the reverse conveyer path ρd at positions Q6, Q7, and Q8, respectively. A distance between the position Q7 and the position Q8 along the common conveyer path ρa and the reverse conveyer path ρd is greater than each of a distance between the position Q1 and the position Q2, a distance between the position Q2 and the position Q5, a distance between the position Q5 and the position Q6, a distance between the position Q6 and the position Q7, and a distance between the position Q8 and Q5 along the conveyer path ρa and the reverse conveyer path ρd. In other words, a distance between the conveyer roller pair 25 and the conveyer roller pair 26 is greater than a distance between the feeder roller 21 and the intermediate roller pair 22 and than a distance between any two adjoining roller pairs on the common conveyer path ρa and the reverse conveyer path ρd.

Therefore, when the rolled sheet Rp is used, if the cutoff-length of the rolled sheet Rp is relatively small, while the rolled sheet Rp may be conveyed from the feeder roller 21 to the conveyer roller pair 25 through the common conveyer path ρa, the rolled sheet Rp conveyed by the conveyer roller pair 25 and entering the reverse conveyer path ρd may not reach the conveyer roller pair 26 due to the shortness of the rolled sheet Rp being shorter than the distance between the conveyer roller pair 25 and the conveyer roller pair 26, and the rolled sheet Rp may not be conveyed to return to the head 5 in the automatic duplex operation.

In this regard, the printer 200 has a controller 209 to conduct an operation as described below. That is, the controller 209 is provided with a first threshold value and a second threshold value, which are reference values to be referred to in order to determine whether the automatic duplex operation is applicable. The first threshold value is smaller than the second threshold value. The second threshold value corresponds to the automatic duplex-operation allowable value described in the first and second embodiments. The first threshold value indicates a length that enables the rolled sheet Rp conveyed by the conveyer roller pair 25 to reach the conveyer roller pair 26 in the reverse conveyer path ρd. In particular, the rolled sheet Rp cut in a length equal to or greater than the length indicated by the first threshold value may reach the conveyer roller pair 26 when conveyed by the conveyer roller pair 25 in the reverse conveyer path ρd. In other words, the first threshold value indicates a length equal to or greater than the distance between the position Q7 and the position Q8. The controller 209 conducts the automatic duplex operation when the cutoff-length is greater than or equal to the first threshold value and equal to or smaller than the second threshold value. On the other hand, when the cutoff-length is smaller than the first threshold value or when the cutoff-length is greater than the second threshold value, the controller 209 conducts the manual duplex operation.

Figure 3:
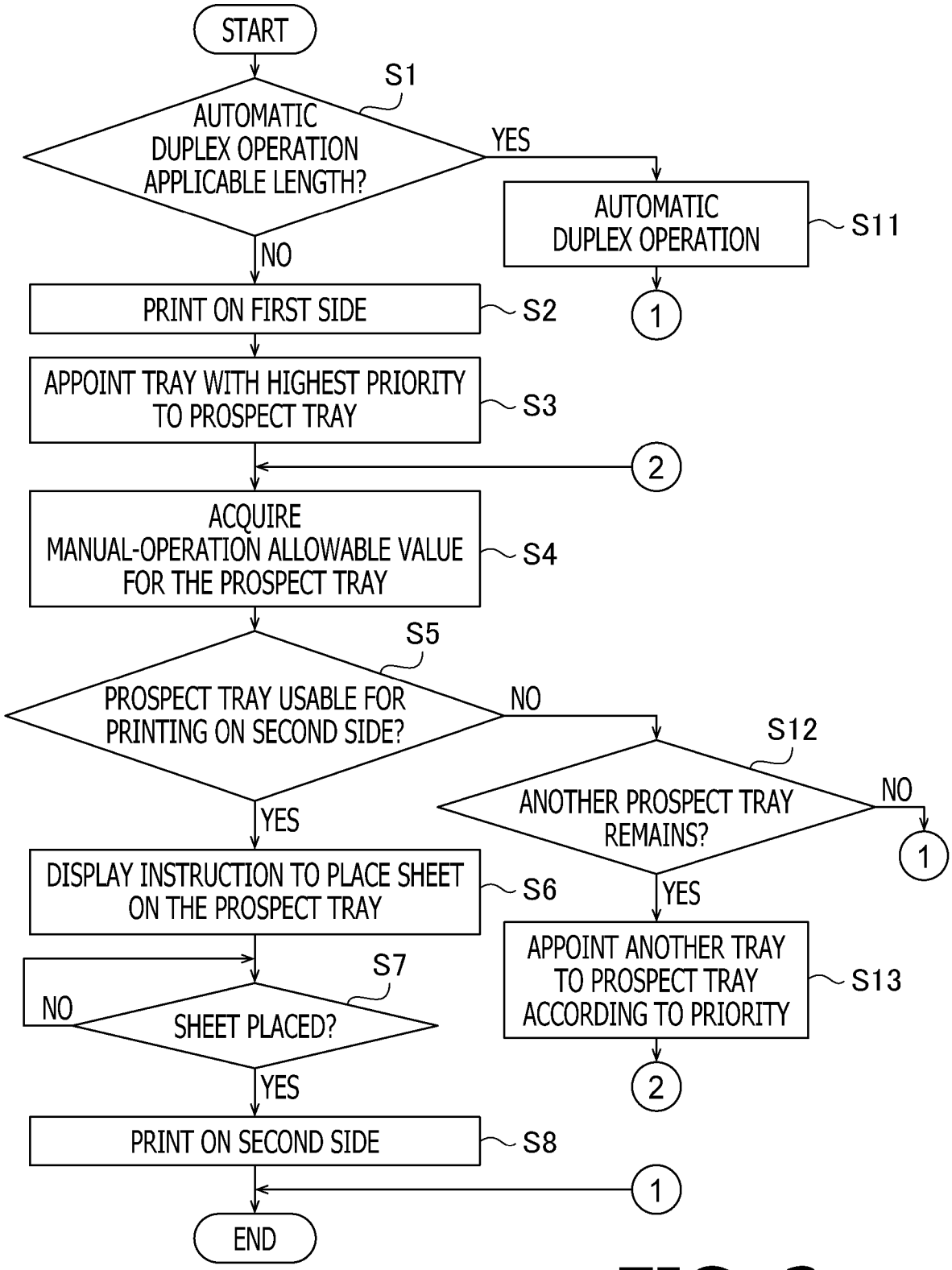
FIG. 3 is a flowchart to illustrate flows of steps in a duplex-operating process to be conducted by a controller to a rolled sheet.
Figure 4:
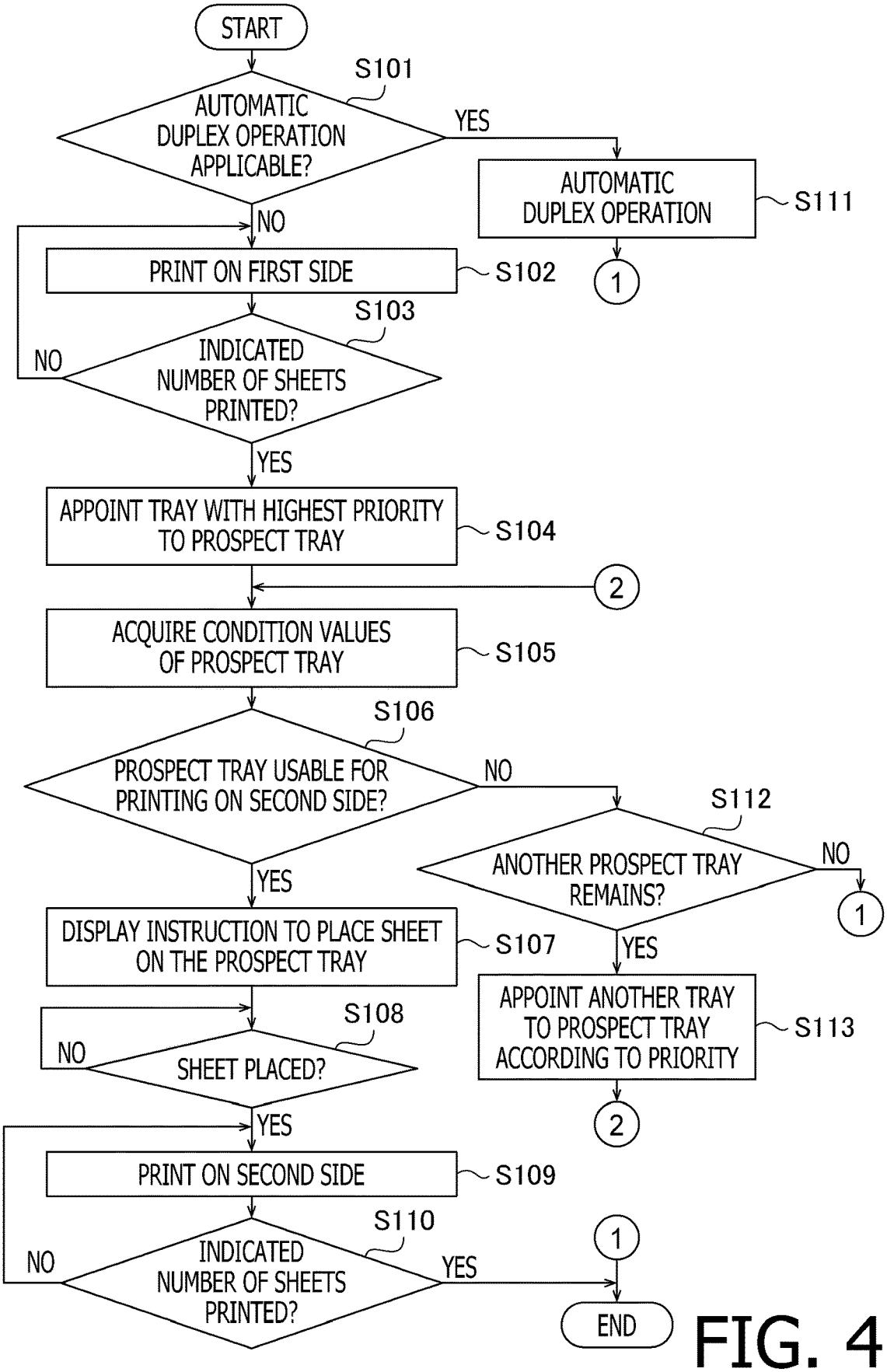
FIG. 4 is a flowchart to illustrate flows of steps in a duplex-operating process to be conducted by a controller to a rolled sheet.
Figure 6:
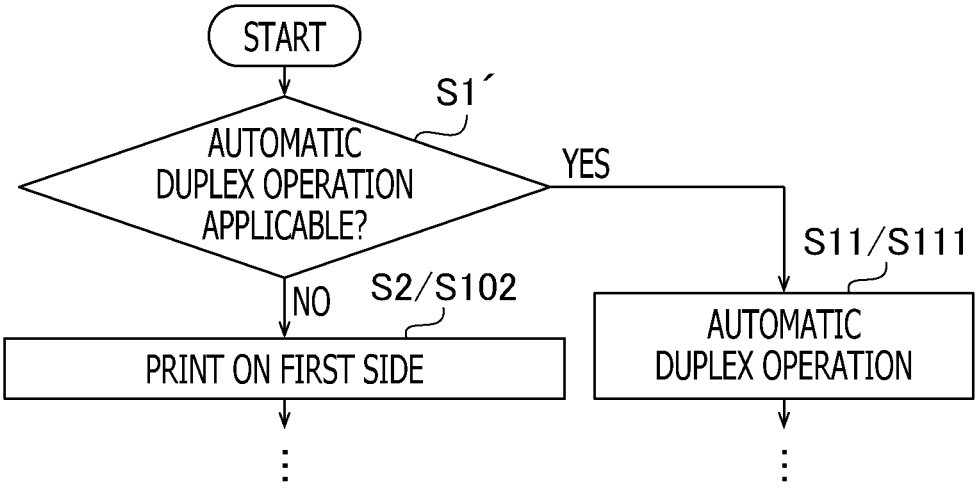
FIG. 6 is a flowchart to illustrate flows of steps in a duplex-operating process to be conducted by a controller to a rolled sheet.

In particular, the controller 209 conducts a flow of processes as shown in FIG. 6, in which the process in S1 in the flowchart in FIG. 3 or the process in S101 in the flowchart in FIG. 4 is replaced with a process S1' described below. In the former case, in which the process S1 in FIG. 3 is replaced with the process in S1', the process in S1' may be conducted in a manner described here in this paragraph. That is, when the cutoff-length indicated in the user command data is greater than or equal to the first threshold value and equal to or smaller than the second threshold value, the controller 209 may determine the automatic duplex operation is applicable (S1': YES). On the other hand, when the cutoff-length indicated in the user command data is either smaller than the first threshold value or greater than the second threshold value, the controller 209 may determine that the automatic duplex operation is not applicable (S1': NO). The flow following S1' may be conducted in the same manner as the flow in the flowchart shown in FIG. 3.

Meanwhile, in the latter case, in which the process in S101 in FIG. 4 is replaced with the process in S1', the process in S1' may be conducted in a manner described here in this paragraph. That is, the controller 209 may determine the automatic duplex operation is applicable (S1': YES) when the cutoff-length indicated in the user command data is greater than or equal to the first threshold value and equal to or smaller than the second threshold value and further when the sheet type indicated in the user command data does not fall into the specific type as described in the second embodiment. On the other hand, when the cutoff-length indicated in the user command data is either smaller than the first threshold value or greater than the second threshold value, or when the sheet type indicated in the user command data falls into the specific type as described in the second embodiment, the controller 209 may determine that the automatic duplex operation is not applicable (S1': NO). The flow following S1' (S2/S102 or S11/S111) may be conducted in the same manner as the flow in the flowchart shown in FIG. 4.

According to the third embodiment, when the automatic duplex operation is inapplicable due to, not only because the rolled sheet Rp is in the relatively large cutoff-length, but also because the rolled sheet Rp is in a relatively small cutoff-length, images may be formed on the both sides of the rolled sheet Rp in the duplex operation.

MORE EXAMPLES

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below.

For example, in the first and second embodiments described above, the controller 9 may determine whether the image may be printed on the second side of the rolled sheet Rp in the prospect feeder tray (S2 in FIG. 3, S102 in FIG. 4) after the image is formed on the first side of the rolled sheet Rp (S5 in FIG. 3, S106 in FIG. 4) during the manual duplex operation. However, optionally, the controller 9 may determine whether the image may be formed on the second side of the rolled sheet Rp and determine the feeder tray to be used for the image forming on the second side of the rolled sheet Rp before the image is formed on the first side of the rolled sheet Rp. In this arrangement, when the controller 9 determines that none of the feeder trays 1*x*, 1*y*, 1*z* is usable for forming the image on the second side of the rolled sheet Rp, optionally, the controller 9 may abort the operation without forming images on neither the first side nor the second side of the rolled sheet Rp.

For another example, in the second embodiment described above, the condition concerning the sheet type is considered both for determining whether the automatic duplex operation is applicable (S101 in FIG. 4) and for determining whether the prospect feeder tray is usable for printing the second side (S106 in FIG. 4). However, optionally, the condition concerning the sheet type may be considered solely in either for determining whether the automatic duplex operation is applicable (S101 in FIG. 4) or for determining whether the prospect feeder tray is usable for printing the second side (S106 in FIG. 4).

For another example, the feeder tray usable for forming the image on the second side of the rolled sheet Rp may not necessarily be informed to the user through the touch-panel display 95 but may be informed to the user in a different form. For example, light-emitting diodes may be arranged in the vicinities of the feeder trays 1*x*, 1*y*, 1*z*, and the user may be informed of the usable feeder tray by the light from the light-emitting diode located in the vicinity of the usable feeder tray. For another example, the user may be informed of the usable feeder tray by audio indication from a speaker.

For another example, in the first and second embodiments, during the manual duplex operation, the prospect tray to place the rolled sheet Rp for forming the image on the second side may not necessarily be appointed from the three feeder trays 1$x$, 1$y$, 1$z$ but may be selected from four or more feeder trays, or solely a single feeder tray may always be appointed to the usable feeder tray.

For another example, in the first through third embodiments, applicability of the automatic duplex operation is determined when the rolled sheet Rp is used for forming the images and based on the cutoff-length of the rolled sheet Rp (see, for example, S1 in FIG. 3, S101 in FIG. 4, and S1' in FIG. 6). In contrast, optionally, applicability of the automatic duplex operation may be determined when a printable medium, e.g., the cut sheet Kp, which may be used and ejected without being cut by the cutter 3 in the printer, is used as the sheet P. In this arrangement, for example, the controller may acquire a length of the printable medium conveyed in the common conveyer path ρa by the conveyer 2 based on output from a medium sensor, which may be located at a specific position on the common conveyer path ρa. Based on the length of the printable medium according to the outputs from the medium sensor rather than the cutoff-length in the user command data, the controller may determine whether the automatic duplex operation is applicable to the printable medium.

For another example, the embodiments described above may not necessarily be applied to the printer 100/200 but may be applied to any image forming apparatuses in the inkjet-printing style, such as multifunction peripheral machine and copier and to any image forming apparatuses in a laser-printing style that may form the images in toners on the sheet P.

What is claimed is:

1. An image forming apparatus, comprising:

a first container configured to accommodate a medium;

a second container configured to accommodate a medium;

an image forming device configured to perform an image forming operation to form an image on an image-formable side of the medium from either one of the first container or the second container;

a medium conveyer configured to selectively perform:

a first conveying operation, in which the medium conveyer conveys the medium from the first container to the image forming device with one of a first side and a second side thereof to be used as the image-formable side;

a second conveying operation, in which, after the image forming operation to the medium conveyed in the first conveying operation, the medium conveyer conveys the medium with the other of the first side and the second side thereof to be used as the image-formable side; and a third conveying operation, in which the medium conveyer conveys the medium from the second container to the image forming device with one of a first side and a second side thereof to be used as the image-formable side, a command acquiring device configured to acquire a user command, the user command indicating at least one of the first side or the second side of the medium accommodated in one of the first container and the second container, on which the image forming operation is to be performed; and a controller configured to:

when the user command indicates that the image forming operation is to be performed on both the first side and the second side of the medium accommodated in the first container, conduct one of a first duplex operation and a second duplex operation, the controller being configured to conduct the first duplex operation when a first condition is satisfied but conduct the second duplex operation when a second condition is satisfied, the first condition including a condition that a length of the medium to be conveyed by the medium conveyer is equal to or smaller than a first predetermined length, the second condition including a condition that the first condition is not satisfied, for the first duplex operation, the controller being configured to control the medium conveyer to perform the first conveying operation and the second conveying operation and control the image forming device to perform the image forming operation on the first side and the second side of the medium from the first container, and for the second duplex operation, the controller being configured to control the medium conveyer to perform the first conveying operation and control the image forming device to perform the image forming operation on the one of the first side and the second side of the medium from the first container, and, after the medium is accommodated in the second container in an orientation with the other of the first side and the second side of the medium opposite to the one side having the image formed thereon to be used as the image-formable side, control the medium conveyer to perform the third conveying operation to the medium from the second container and control the image forming device to perform the image forming operation to the medium conveyed from the second container in the third conveying operation.

2. The image forming apparatus according to claim 1, comprising a plurality of second containers, each of which is the second container, wherein for each one of the plurality of second containers, the controller defines a range of acceptable lengths of the medium, and the second condition includes a condition that the plurality of second containers include at least one second container, of which range of the acceptable lengths of the medium encompasses a length of the medium to be conveyed by the medium conveyer in the second duplex operation.

3. The image forming apparatus according to claim 2, further comprising an informing device, wherein the controller is configured to control the informing device to inform a user about the at least one second container, of which range of the acceptable length of the medium encompasses the length of the medium to be conveyed by the medium conveyer.

4. The image forming apparatus according to claim 3, wherein the controller defines a priority order of the plurality of second containers, and the controller is configured to control the informing device to inform the user about one of the at least one second container, of which range of the acceptable length of the medium encompasses the length of the medium to be conveyed by the medium conveyer, having a highest priority.

5. The image forming apparatus according to claim 1, wherein at least one of the first condition or the second condition includes a condition concerning characteristics of the medium.

6. The image forming apparatus according to claim 1, wherein, for the second duplex operation, the controller is configured to:

control the medium conveyer to perform the first conveying operation and the image forming device to perform the image forming operation repetitively for a plurality of times on one of a first side and a second side of each of a plurality of pieces of medium, and after the plurality of pieces of medium are accommodated in the second container in an orientation reversed from an orientation of the plurality of pieces of medium in the first conveying operation, control the medium conveyer to perform the third conveying operation and the image forming device to perform the image forming operation repetitively on the other of the first sides and the second side of each of the plurality of pieces of medium from the second container.

7. The image forming apparatus according to claim 6, comprising a plurality of second containers, each of which is the second container, wherein for each one of the plurality of second containers, the controller defines a range of acceptable amounts of the medium, and the second condition includes a condition that the plurality of second containers include at least one second container, of which range of the acceptable amounts of the medium encompasses an amount of the medium to be accommodated therein in the second duplex operation.

8. The image forming apparatus according to claim 1, wherein the first condition includes a condition that a length of the medium to be conveyed by the medium conveyer is equal to or greater than a second predetermined length, the second predetermined length being smaller than the first predetermined length.

9. The image forming apparatus according to claim 1, further comprising a cutter configured to cut the medium to be conveyed by the medium conveyer.

10. An image forming apparatus, comprising:

a first container configured to accommodate a medium;

a second container configured to accommodate a medium;

an image forming device configured to perform an image forming operation to form an image on an image-formable side of the medium from either one of the first container or the second container;

a medium conveyer configured to convey the medium, the medium conveyer including:

a conveyer path, including:

a common conveyer path extending from the first container through the image forming device to an exit of the image forming apparatus; and a reverse conveyer path branched off from the common conveyer path at a branch point, extending to a position overlapping the image forming device, and merging with the common conveyer path at a merge point, the reverse conveyer path and a part of the common conveyer path between the merge point and the branch point forming a closed path;

a first roller located at a position downstream from the branch point in a conveying direction to convey the medium in the conveyer path; and a second roller located in the reverse conveyer path, the medium conveyer being configured to selectively perform:

a first conveying operation, in which the medium conveyer conveys the medium from the first container to the image forming device with one of a first side and a second side thereof to be used as the image-formable side;

a second conveying operation, in which, after the image forming operation to the medium conveyed in the first conveying operation, the medium conveyer conveys the medium with the other of the first side and the second side thereof to be used as the image-formable side; and a third conveying operation, in which the medium conveyer conveys the medium from the second container to the image forming device with one of a first side and a second side thereof to be used as the image-formable side, a command acquiring device configured to acquire a user command, the user command indicating at least one of the first side or the second side of the medium accommodated in one of the first container and the second container, on which the image forming operation is to be performed; and a controller configured to:

when the user command indicates that the image forming operation is to be performed on both the first side and the second side of the medium accommodated in the first container, conduct one of a first duplex operation and a second duplex operation, the controller being configured to conduct the first duplex operation when a first condition is satisfied but conduct the second duplex operation when a second condition is satisfied, the first condition including a condition that a length of the medium to be conveyed by the medium conveyer is encompassed in a range greater than or equal to a first threshold value and smaller than or equal to a second threshold value, the first threshold value being smaller than the second threshold value, the second condition including a condition that the first condition is not satisfied, for the first duplex operation, the controller being configured to control the medium conveyer to perform the first conveying operation and the second conveying operation and control the image forming device to perform the image forming operation on the first side and the second side of the medium from the first container, and for the second duplex operation, the controller being configured to control the medium conveyer to perform the first conveying operation and control the image forming device to perform the image forming operation on the one of the first side and the second side of the medium from the first container, and, after the medium is accommodated in the second container in an orientation with the other of the first side and the second side of the medium opposite to the one side having the image formed thereon to be used as the image-formable side, control the medium conveyer to perform the third conveying operation to the medium from the second container and control the image forming device to perform the image forming operation to the medium conveyed from the second container in the third conveying operation, wherein the first threshold value corresponds to a length equal to or greater than a distance between the first roller and the second roller along the common conveyer path and the reverse conveyer path, and wherein the second threshold value corresponds to a length equal to or smaller than a length of the closed path.

11. The image forming apparatus according to claim 10, wherein the second condition further includes a condition concerning characteristics of the medium.

12. The image forming apparatus according to claim 10, wherein the medium conveyer further includes a plurality of rollers located along the conveyer path, and the distance between the first roller and the second roller is greater than a distance between any two adjoining ones of the plurality of rollers located along the conveyer path.

13. The image forming apparatus according to claim 10, wherein the medium conveyer further includes a plurality of rollers located along the conveyer path, the plurality of rollers including:

a third roller located at a most upstream position along the conveyer path in the conveying direction among the plurality of rollers, the third roller being configured to forward the medium from the first container to the conveyer path;

a fourth roller located between the third roller and the merge point along the conveyer path;

a fifth roller located at a position downstream from the fourth roller and upstream from the image forming device in the conveying direction; and a sixth roller located at a position downstream from the image forming device in the conveying direction, and the distance between the first roller and the second roller along the common conveyer path and the reverse conveyer path is greater than each of a distance between the third roller and the fourth roller along the common conveyer path, a distance between the fourth roller and the fifth roller along the common conveyer path, a distance between the fifth roller and the sixth roller along the common conveyer path, a distance between the sixth roller and the first roller along the common conveyer path, and a distance between the second roller and the fifth roller along the reverse conveyer path and the common conveyer path.

14. The image forming apparatus according to claim 10, comprising a plurality of second containers, each of which is the second container, wherein for each one of the plurality of second containers, the controller defines a range of acceptable lengths of the medium, and the second condition includes a condition that the plurality of second containers include at least one second container, of which range of the acceptable lengths of the medium encompasses a length of the medium to be conveyed by the medium conveyer in the second duplex operation.

15. The image forming apparatus according to claim 14, further comprising an informing device, wherein the controller is configured to control the informing device to inform a user about the at least one second container, of which range of the acceptable length of the medium encompasses the length of the medium to be conveyed by the medium conveyer.

16. The image forming apparatus according to claim 15, wherein the controller defines a priority order of the plurality of second containers, and the controller is configured to control the informing device to inform the user about one of the at least one second container, of which range of the acceptable length of the medium encompasses the length of the medium to be conveyed by the medium conveyer, having a highest priority.

17. The image forming apparatus according to claim 10, further comprising a cutter configured to cut the medium to be conveyed by the medium conveyer.

* * * * *